US005806359A

United States Patent [19]

Hequet

[11] Patent Number: 5,806,359

[45] Date of Patent: Sep. 15, 1998

[54] OPTIMIZED OPERATION OF A TWO STAND REVERSING ROLLING MILL

[75] Inventor: Roland N. Hequet, Pittsburgh, Pa.

[73] Assignee: Kvaerner U.S. Inc., Pittsburgh, Pa.

[21] Appl. No.: 743,317

[22] Filed: Nov. 5, 1996

[51] Int. Cl.[6] ..... B21B 41/06; B21B 39/08

[52] U.S. Cl. ..... 72/229; 72/205

[58] Field of Search ..... 72/200, 201, 202, 72/228, 229, 225, 234, 235, 237, 238, 224, 205

[56] References Cited

U.S. PATENT DOCUMENTS

| | | | |
|---|---|---|---|
| 372,747 | 11/1987 | Everson . | |
| 946,795 | 1/1910 | Fawell . | |
| 1,964,503 | 6/1934 | Coryell . | |
| 3,331,232 | 7/1967 | King . | |
| 3,485,077 | 12/1969 | Wilson . | |
| 4,348,882 | 9/1982 | Tippins . | |
| 4,497,191 | 2/1985 | Langer et al. . | |
| 4,522,050 | 6/1985 | Thomas . | |
| 4,580,428 | 4/1986 | Brettbacher . | |
| 5,660,070 | 8/1997 | Muryn et al. | 72/229 |
| 5,706,690 | 3/1995 | Connolly | 72/229 |

FOREIGN PATENT DOCUMENTS

| | | | |
|---|---|---|---|
| A-60-102208 | 6/1985 | Japan | 72/229 |
| A-61-238411 | 10/1986 | Japan | 72/229 |

*Primary Examiner*—Lowell A. Larson
*Assistant Examiner*—Rodney Butler
*Attorney, Agent, or Firm*—Armstrong, Westerman, Hattori, McLeland & Naughton

[57] ABSTRACT

A process for operation of a two-stand reversing mill optimizes product yield and time productivity in rolling strip in two or more passes through the mill, by bringing, in each pass, a tail end of the rolled strip to but not into the first roll stand through which the remainder of the strip has last been passed, gripping said tail end on a reel serving as an exit reel, rolling the strip and coiling it onto said exit reel. In a next to last pass after the first pass, a portion, e.g. about 1 ½ wraps, of the strip may be left on a reel serving as an entry reel to maintain strip tension.

13 Claims, 3 Drawing Sheets

Start Of Pass 1

End Of Pass 1 (1 Pass)

End Of Pass 1 (2 or 3 Passes)

End Of Pass 2 (2Passes)

End Of Pass 2 (3Passes)

End Of Pass 3 (3Passes)

OPTIMIZED OPERATION OF A TWO STAND REVERSING ROLLING MILL

BACKGROUND OF THE INVENTION

1. Field of the Invention

This invention relates to an optimized method of operation of a two-stand reversing rolling mill in order to achieve enhanced yield of cold rolled product and improved productivity of the mill.

2. Description of the Prior Art

As far as is known to the inventor, no two-stand reversing cold rolling mill exists except as disclosed in co-pending application Ser. No. 08/728,848, filed Oct. 10, 1996 entitled "Two Stand Cold Reduction Reversing Mill", by Norbert Monier and having a common assignee with this present invention, which application is incorporated herein by this reference. In the latter invention, sheet and strip (hereinafter called "strip") to be cold rolled is threaded, from an entry reel, through the two stands of the mill, and onto an exit reel. In a first cold rolling pass through the mill, about 1½ wraps of strip are left on the entry reel on completion of cold rolling and, on reversing of the mill and cold rolling in a second pass, about 1½ wraps of strip are left on the exit reel. Such process is repeated for subsequent passes of strip through the mill. Such operation results in significant product yield loss represented by the unrolled strip which is left on the entry and exit reels and between those reels and the work rolls.

Similar product loss is incurred in similar operation of prior art single stand rolling mills in which such mills are operated by opening the mills during threading and always to keep the strip gripped on the entry and exit reels during rolling, thus leading to an important quantity of metal not being rolled to final gauge.

In reduction of strip in a tandem operation of a rolling mill, strip is rolled through the mill, the strip is dethreaded and coiled and the coil is brought back to the front of the mill, rethreaded through the work rolls, rolled, dethreaded and coiled on the exit reel. Such process may be repeated as many times as needed to effect the desired degree of reduction of strip thickness. Threading of strip through a rolling mill is time consuming and results in costly reduction of mill time usage, i.e. productivity. Additionally, threading of strip through the mill tends to damage the work rolls, so that repeated threading is to be avoided insofar as possible.

SUMMARY OF THE INVENTION

In accordance with this invention, multiple passes through the two stands of the contemplated two stand rolling mill are effected by passing the strip, from a pay-off reel, through the preset mill so as to achieve a target gauge from the head end of the strip, and coiling it on a reel serving as an exit reel until the tail of the strip is just in front of a first of two roll stands through which the remainder of the strip has last been passed. The mill then is reversed, the tail end of the strip becoming the head end which is gripped on a reel serving as an exit reel and the strip rolled until the tail end reaches the front of the first of two roll stands through which the remainder of the strip has last been passed. This process is repeated as many times as necessary. Such operation results giving the best compromise between yield performance and productivity; lengths of strip left on the entry and exit reels and between those reels and the work rolls can be rolled, thereby increasing yield of rolled product. Also, the need for rethreading through the work rolls is avoided, thereby increasing productivity and decreasing wear and tear on the work rolls. To increase productivity, in certain passes, a portion, e.g. 1½ wraps, of the strip may remain on the tension reel(s).

DESCRIPTION OF PREFERRED EMBODIMENTS

Figure 1:
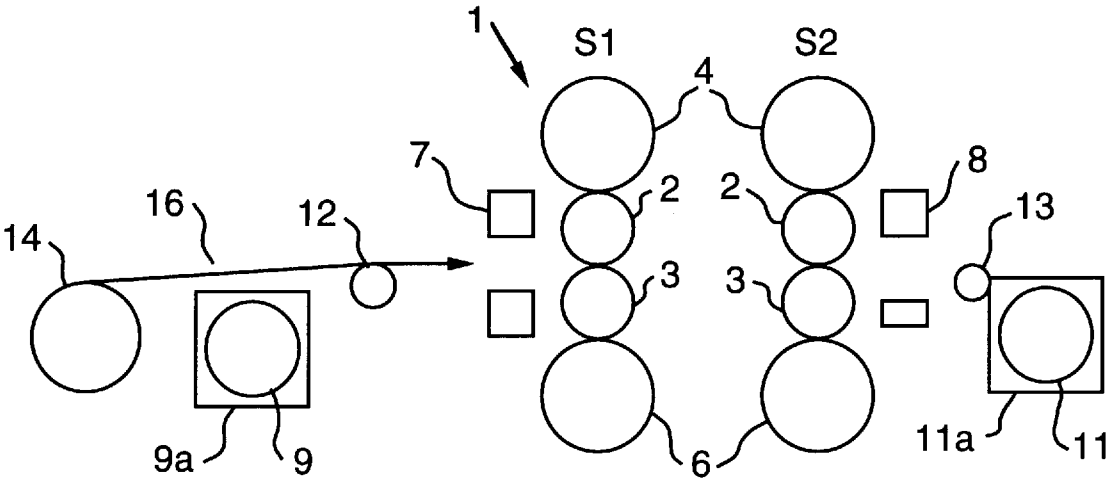
FIG. 1 is a schematic side elevational view of a two-stand rolling mill rolling metal strip and at the start of a first rolling pass of strip through the mill.

FIG. 1 shows a two-stand rolling mill generally denoted by the numeral 1, comprising a first roll stand, S1, and a second roll stand S2, each stand comprising a pair of upper and lower work rolls 2 and 3, respectively, and a pair of backup rolls, 4 and 6, respectively, an entry press board 7, an exit press board 8, an entry reel 9, and exit reel 11, a entry deflector roll 12, an exit deflector roll 13, and a pay-off reel 14. In the case of a hot rolling mill, coiler furnaces 9*a* and 11*a* are provided, as shown in FIG. 1 and it is to be understood that they would be present in the other FIGS. as well. In the case of a cold rolling mill, such furnaces are not required.

In commencing operation of a two-stand rolling mill in accordance with this invention, in order to maximize both product yield and mill productivity, the mill roll gap is preset in order to achieve the correct product thickness at the end of the first pass, with both stands closed. A coil of strip 16 is placed on the pay-off reel 14, as shown in FIG. 1, and strip 16 is threaded, from reel 14, through the work rolls 2 and 3 of each stand S1 and S2, and the head end is gripped on exit reel 11 with about 1½ wraps of strip about reel 11, and the mill is accelerated up to nominal rolling speed. Near completion of the first pass of strip through the two stands of the mill, the mill decelerates automatically, in accordance with strip length, to tail out speed.

Figure 2:
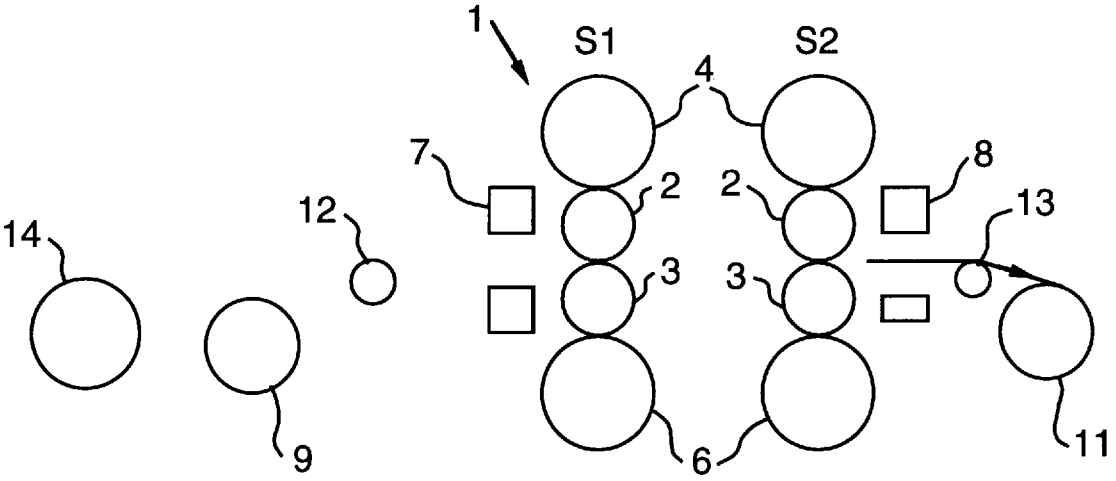
FIG. 2 is a similar view showing operation of the mill at the end of a single and final pass.

As shown in FIG. 2, for one pass rolling, the strip tail is passed through both roll stands S1 and S2 (with closed roll gap), and coiled on exit reel 11; the coil then is ready for removal from the mill.

Figure 3:
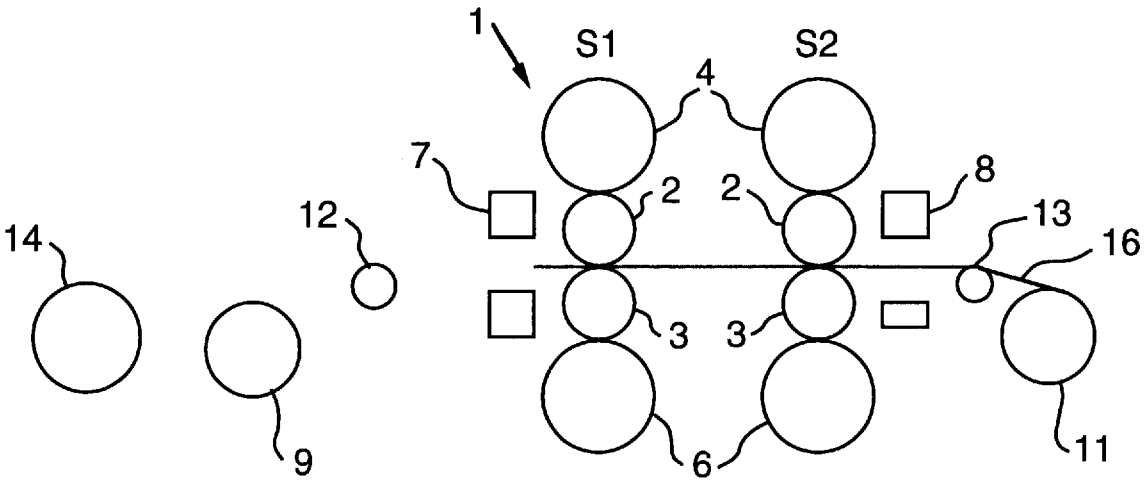
FIG. 3 is a similar view showing the end of a first pass of multiple passes.
Figure 4:
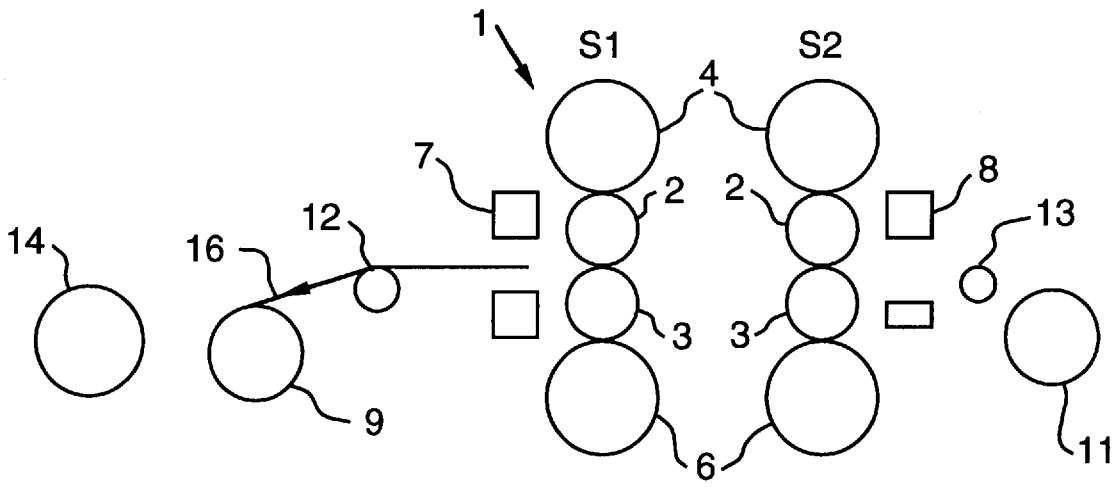
FIG. 4 is a similar view showing the end of a second and final pass.

As shown in FIG. 3, for two, three or more passes of strip through the mill, at the end of the first pass, the strip tail is stopped in front of stand S1, the first roll stand through which the remainder of strip 16 was passed on the first pass. The roll gaps of stands S1 and S2 are adjusted for the desired thickness reduction in each stand; the mill then is reversed and the tail, now the head end of the strip, is gripped on reel 9, now serving as an exit reel, and the mill is then accelerated to pass 2 nominal speed. For two pass products, the mill is decelerated, with automatic slowdown, to tail out speed, press board 8 is closed, as shown in FIG. 4, before losing tension on reel 11 which, in that FIG. is serving as an entry reel, and the strip tail then is evacuated through both stands (with closed roll gap) with the final strip coiled on reel 9.

Figure 5:
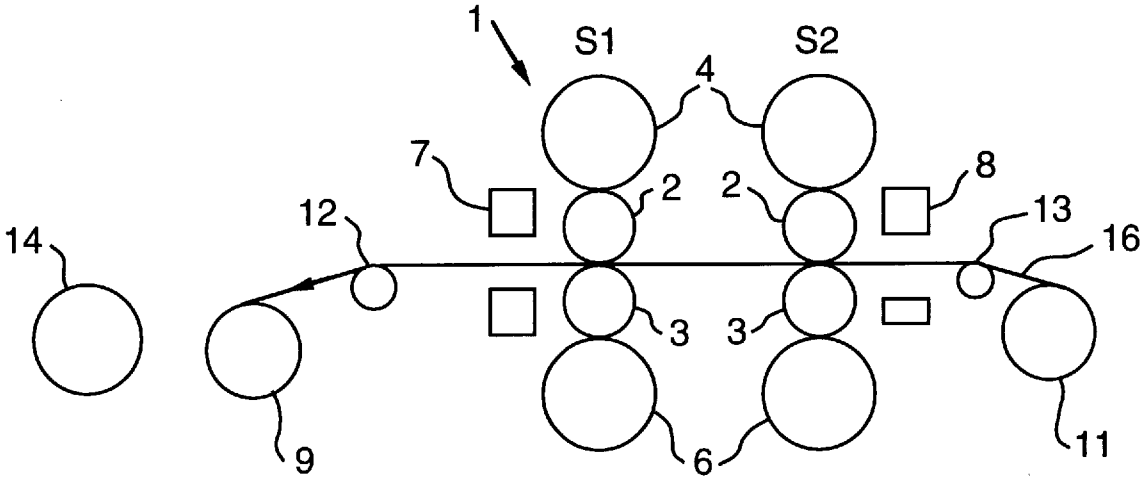
FIG. 5 is a similar view showing the end of a second of three passes.
Figure 6:
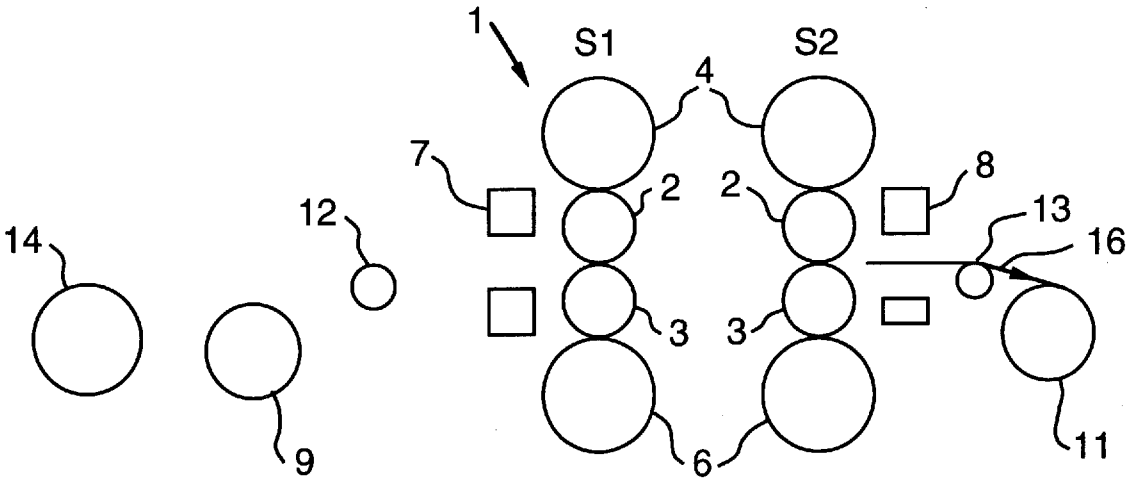
FIG. 6 is a similar view showing the end of a third and final pass of strip through the mill.

For 3 pass products, at the end of pass 2, the mill is decelerated and about 1½ wraps of strip are left on reel 11, as shown in FIG. 5, as a compromise between yield and productivity. Alternatively, for maximum product yield but at cost of some productivity time, the tail end of strip 6 can be stopped in front of stand S2, i.e. the first stand through which the remainder of strip 16 was passed in the last (second) pass of the strip through the mill and, on reversal of the mill, the tail end, now the head end of the strip, can be gripped on reel 11. In any case, the mill is reversed and strip 16 is rolled through stands S1 and S2 and coiled on reel 11, serving as an exit reel, and is ready for removal from the mill. As shown in FIG. 6, press board 7 is closed to maintain tension on the strip 16 before tension is lost on reel 9. A useful device for gripping the end of the strip being rolled in accordance with this invention is a coiler spool with built-in gripper, as disclosed in co-pending application Ser. No. 08/743,839, filed on Nov. 6, 1996, entitled "Coiler Spool with Built-In Gripper Slot", by Slade and Hequet, assigned to the assignee of this invention, and incorporated herein by this reference.

The increased yield and productivity resulting from operation of a two-stand reversing mill in accordance with this invention are illustrated by the data set out in Table I in which there are compared three operating practices: 1) operation of the two-stand rolling mill as a tandem mill in which, after a pass through the mill, the mill is dethreaded, the coil of rolled strip is brought back to the front of the mill, rethreaded and rerolled; 2) the mill is operated in accordance with standard reversing mill practice in which the head and tail ends of the coil are kept wrapped, e.g. 1½ wraps, respectively on the entry and exit reels in order to maintain tension on those respective reels, and the mill then is reversed, and 3) the optimized practice as above described and shown. Table I results are based on 2-pass rolling schedules.

TABLE I

| Type of Operation | Typical Yield Loss, kg/ton | Typical Productivity Loss/Year/Pass, Hours | |
|---|---|---|---|
| Tandem mill type | 12 | 1st pass | 61 |
| | | 2nd pass | 244 |
| Standard reversing mill type | 26 | 1st pass | 0 |
| | | 2nd pass | 244 |
| Optimized rolling type | 15 | 1st pass | 61 |
| | | 2nd pass | 0 |

From Table I, it is seen that the optimized operation of the invention is about as good as the tandem mill type operation as regards yield loss, but is about twice as good as the standard reversing mill type operation. As regards mill time productivity, the best case for a single, first pass is the single reversing mill type operation which only requires a threading of the strip with opened roll stands. With respect to a 2-pass process, however, the optimized operation is drastically improved over either tandem mill or standard reversing mill practice.

Thus, the improved, optimized rolling practice of the invention provides outstanding productivity and good yield for a two stand reversing cold mill and thereby makes such a mill highly competitive with, and, indeed, superior to, normal reversing mill practice or tandem mill operation.

What is claimed is:

1. A method of operating a two-stand reversing rolling mill to improve mill productivity and rolled product yield, said mill having two spaced-apart pairs of vertically disposed work rolls with an adjustable roll gap therebetween, comprising passing an elongated strip in a first pass through the two mill roll stands from a pay-off reel disposed upstream of a first tension reel disposed upstream of a first roll stand to a second tension reel disposed downstream of a second roll stand, in a manner such that a tail end of the strip being rolled is brought to but not into the roll gap between the work rolls in the first roll stand, reversing the mill, holding such tail end of the strip on the first tension reel, again rolling the strip in n passes through the mill, where n is 2 or more, and, in each pass, in such manner that a tail end of the strip is brought to but not into the roll gap between the work rolls in the roll stand through which the remainder of the strip has last been passed, and, as a compromise between yield and productivity, at the end of the n-1 pass holding such tail end of the strip on a tension reel serving as an entry reel, and coiling the strip onto a tension reel serving as an exit reel.

2. A method according to claim 1, wherein, in the n-1 pass, when n is more than 2, sufficient strip is left on the tension reel serving as an entry reel to maintain strip tension on said tension reel.

3. A method according to claim 1, wherein rolling is terminated after a third pass through the mill and, after the second pass, maintaining about one and one-half wraps of the tail end of the strip on the second reel.

4. A method according to claim 1, wherein rolling is continued for one or more passes after the second pass, and, on each successive pass through the mill, a tail end of the rolled strip is brought to but not into the roll gap between the first pair of work rolls through which the remainder of the strip has last been passed.

5. A method according to claim 1, wherein, after the n-1 pass, the process includes maintaining about one and one-half wraps of the tail end of the strip on a reel serving as an entry reel.

6. A method according to claim 4, wherein, after the next-to-last pass of the strip through the mill, about one and one-half wraps of the tail end of the strip is maintained on a reel serving in that pass as an entry reel.

7. A method of operating a two-stand reversing rolling mill to improve mill productivity and rolled product yield, said mill having a first tension reel disposed upstream of a first roll stand and a second tension reel disposed downstream of a second roll stand, with two or more passes of an elongated strip through the mill, comprising threading the strip to be rolled through the roll stands, rolling the strip in a first pass through the roll stands, coiling the rolled strip on the second tension reel and bringing a tail end of the strip to but not into the first roll stand, rolling the strip in one or more additional passes through the roll stands and in each successive pass bringing a tail end of the strip to but not into the first roll stand through which the remainder of the strip has last been passed, thereby reducing product loss by rolling lengths of strip on the tension reels and between the tension reels and mill stand work rolls, and increasing mill productivity by reducing the need for rethreading of the strip through the work rolls.

8. A method according to claim 7, wherein, in the next to last pass after the first pass, leaving sufficient strip on the tension reel serving as an entry reel to maintain strip tension on said tension reel.

9. A method according to claim 7, wherein the mill further comprises a first press board between the first reel and the first roll stand and a second press board between the second reel and the second roll stand, and wherein, in the last pass of strip through the mill, the press board adjacent the first roll stand to roll the strip in the last pass is closed to maintain tension on the strip before tension is lost on the reel serving as an entry reel in the last pass.

10. A method according to claim 9, wherein one or more passes are made through the roll stands, and wherein, at the end of pass one, the first press board is closed to maintain tension on the strip before tension is lost on the second reel.

11. A method according to claim 9, wherein two or more passes are made through the roll stands, and wherein, at the end of pass two, the second press board is closed to maintain tension on the strip before tension is lost on the second reel.

12. A method according to claim 9, wherein three or more passes are made through the roll stands, and wherein, at the end of pass three, the first press board is closed to maintain tension on the strip before tension is lost on the first reel.

13. A method according to one of claims 1–4 or 6–13, wherein the mill is a cold rolling mill.

* * * * *